United States Patent [19]

Qually et al.

[11] Patent Number: 4,527,944

[45] Date of Patent: Jul. 9, 1985

[54] WHEELCHAIR TILTING DEVICE

[76] Inventors: Marvin C. Qually, 215 Dieppe Rd., Lethbridge, Alberta, Canada, T1J 3W8; Henry P. Vogt, 1824 - 12th Ave. S., Lethbridge, Alberta, Canada, T1K 0N6

[21] Appl. No.: 478,240

[22] Filed: Mar. 24, 1983

[51] Int. Cl.[3] ..... A47C 31/00

[52] U.S. Cl. ..... 414/678; 297/DIG. 4; 414/921

[58] Field of Search ..... 414/462, 678, 921; 297/326, 327, DIG. 4

[56] References Cited

U.S. PATENT DOCUMENTS

| | | | |
|---|---|---|---|
| 2,295,006 | 9/1942 | Philips | 297/DIG. 4 |
| 2,339,361 | 1/1944 | Sill et al. | 297/327 X |
| 3,476,404 | 11/1969 | Rachman | 297/DIG. 4 |
| 3,888,463 | 6/1975 | O'Brien et al. | 414/921 X |
| 4,192,549 | 3/1980 | Petersen | 297/DIG. 4 |

*Primary Examiner*—Robert J. Spar
*Assistant Examiner*—Janice Krizek
*Attorney, Agent, or Firm*—Stanley G. Ade

[57] ABSTRACT

A tilting device for a wheelchair and occupant comprises an outer frame defining a base and upstanding triangular supports at an inner frame pivotally mounted on the outer frame at the top of the triangular supports. The inner frame comprises a back rest and platform with a rearwardly extending section to receive the wheels of the wheelchair and parallel guides spaced by the width of the wheelchair to prevent twisting. The pivot axis passes through the occupant and the inner frame can be pivoted relative to the outer frame by operation of a handle which rotates a screw, axial movement of which acts to pivot the inner frame by actuation of suitable levers.

10 Claims, 4 Drawing Figures

WHEELCHAIR TILTING DEVICE

BACKGROUND OF THE INVENTION

This invention relates to a device for tilting wheelchairs rearwardly to allow the occupant to attain a rearwardly inclined position.

Devices of this sort are necessary for various reasons to allow the occupant to be tilted rearwardly without the necessity of removing the occupant from the wheelchair and placing him or her in a separate chair which can be reclined. It is necessary for the device to be simply manually operable with assistance from a healthy person or usually one who is trained thus allowing the occupant to assume the reclined position and at the same time provide the occupant with the possibility of self operation as well.

SUMMARY OF THE INVENTION

It is one object of the invention therefore to provide a simple device for tilting a wheelchair and occupant rearwardly while maintaining the wheelchair safely secured during the tilting movement.

Accordingly the invention provides an apparatus for tilting a wheelchair and occupant backwardly comprising a first frame having a base for mounting on the floor, a second frame, means mounting the second frame on the first frame so as to be pivotally movable thereon from a first position to a second position angularly rotated from the first position and manually operable means for rotating the second frame between the first and second positions, the second frame including guide means for receiving the wheels of the wheelchair in the first position and support means for supporting the rear of the chair and the back of the occupant in the second position.

According to one advantage of the invention the first frame is triangular and provides a pivot axis for the second frame raised from the floor by the triangular first frame so the pivot axis passes substantially through the occupant approximately at the center of gravity of the chair and occupant. In this way little effort is necessary to tilt the occupant and chair and also the occupant feels secure during the tilting movement since his center of gravity is not moved vigorously rearwardly in order to attain the tilting movement.

According to a further advantage of the invention the device for actuating the movement comprises a manually operable handle and attached screw so that the patient or occupant can himself readily attain the tilted position without the assistance of a skilled healthy operative.

According to a yet further advantage the second frame includes a platform and ramp for readily receiving the wheels of the wheelchair while in the untilted position and also a rearwardly extending frame portion supporting wheel guides confining the wheels and chair onto the platform.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
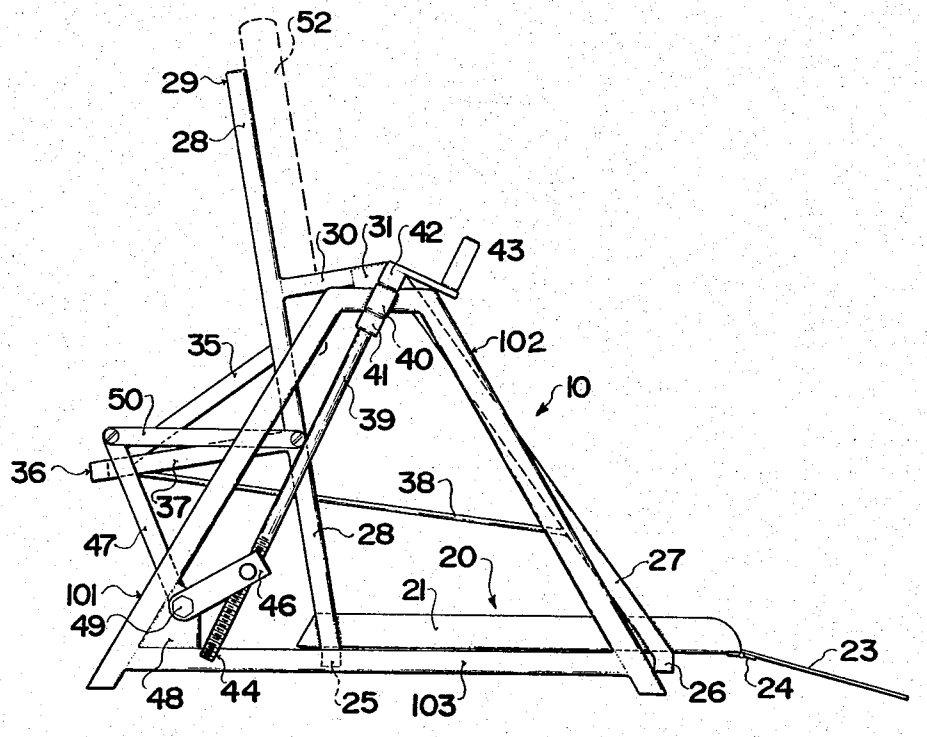
FIG. 1 is a side elevational view of a wheelchair tilt apparatus in the first or untilted position.
Figure 2:
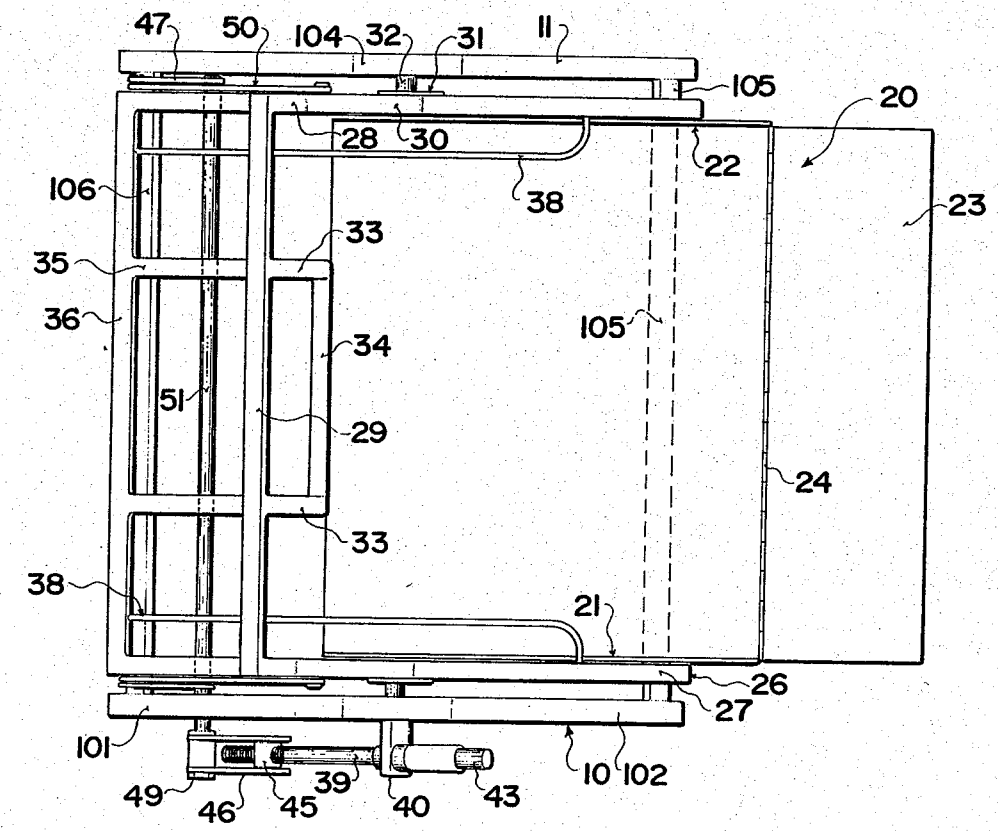
FIG. 2 is a plan view of the apparatus of FIG. 1.
Figure 3:
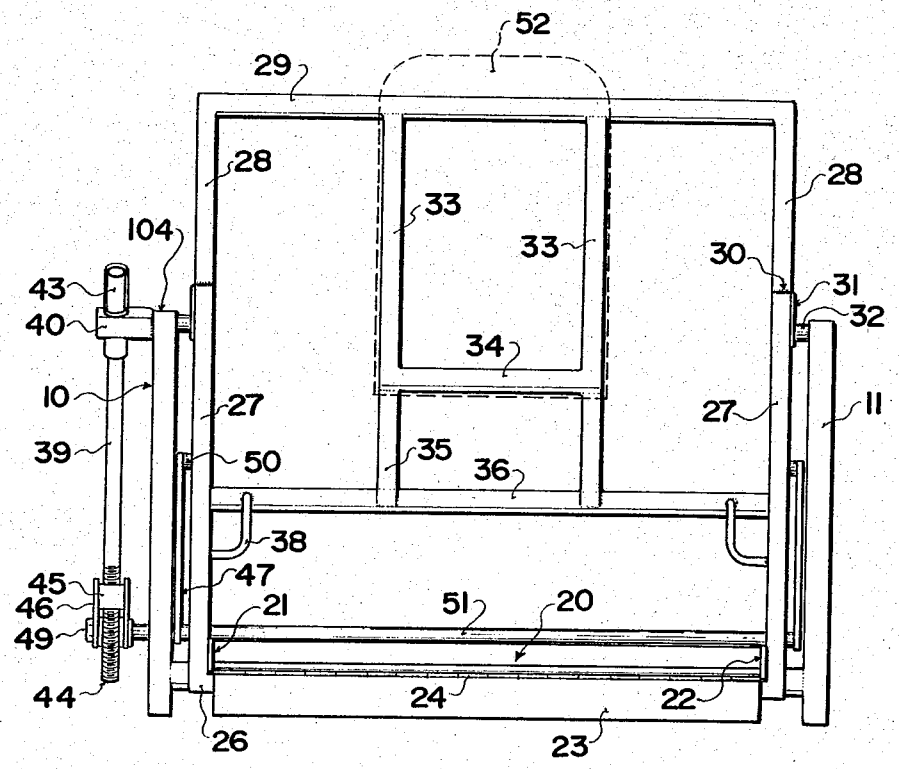
FIG. 3 is a front view of the apparatus of FIG. 1.

The wheelchair tilting apparatus comprises a first frame having two side frame portions 10 and 11 each of which comprises a substantially triangular frame defined by legs 101 and 102 and cross member 103. The legs 101 and 102 extend substantially to an apex at the upper end closed by a cross member 104. The two side frames 10 and 11 are interconnected by cross members 105, 106 connecting with the legs 101, 102 respectively adjacent the junction thereof with the cross member 103. In this way a rigid rectangular base is formed for resting upon the floor and extending upwardly to define a support at the apex.

The second frame comprises a platform 20 formed by a sheet metal pan with upstanding sides 21, 22. At the front of the platform 20 is pivotally mounted a ramp 23 on a hinge 24 which extends from the front edge of the platform 20 to the floor to allow a wheelchair to be readily rolled onto the platform 20.

The platform 20 supported on cross members 25, 26 extending transversely beneath the platform 20 is connected to upstanding side frame portions 28, 27 respectively. The side frame portions 28 extend upwardly at the rear of the platform so as to define a back rest interconnected by a top cross member 29 of the same width as the platform 20. The side frame portions 27 extend upwardly and rearwardly from the platform toward the portions 28 and are interconnected thereto by a rearwardly extending portion 30.

A flange 31 extending across the corner between the portions 30 and 27 provides a support for receiving a pivot pin 32 extending inwardly from the cross member 104 of the fixed first frame. In this way the whole of the second frame is pivotal about a horizontal axis defined by the pivot pins 32.

The second pivotal frame further includes downwardly extending frame portions 33 which lie in the same plane as the portions 28 and 29 and which are interconnected by a cross member 34. Extending rearwardly from the cross member 34 at the same width as the portions 33 are two further frame portions 35 which extend rearwardly and downwardly toward a cross member 36 extending the full width of the second frame. The cross member 36 is interconnected to the downwardly depending portions 28 by further portions 37 which are shown in FIG. 1 lie at an angle to the downwardly depending portion 35.

Guide bars 38 are connected at one end to the cross member 36 and the next end forwardly and parallel to a position adjacent the front of the second frame where they curve outwardly to be connected to the frame 27. Thus the guides 38 are parallel and spaced by a distance substantially equal to the outside of the wheels of a wheelchair so that they can act as guides to limit the movement of the wheelchair sidewardly on the frame to protect the hands of the wheelchair occupant and to ensure that it is prevented from twisting on the platform 20.

The pivot pin 32 on one side of the frame, is extended beyond the fixed frame side to provide a block 40 which is an integral part of the pin 32. The block 40 acts as a guide for a shaft 39 which is free to rotate in the block 40 but is prevented from axial movement relative thereto by a collar 41 and by a handle 42 both of which are fixed to the shaft 39. The handle 42 includes a manually operable crank 43 which can be used to rotate the shaft 39 in the block 40. The other end of the shaft 39 includes a screw 44 carrying a nut 45 so that rotation of the shaft 39 acts to move the nut axially of the shaft with a large mechanical advantage being provided by the crank 43.

The nut 45 is connected to a lever 46 which is bifurcated so as to prevent rotational movement of the nut 45 about the shaft 39 and is rigidly connected to a further lever 47 at a fixed angle thereto. The lever 46, 47 is pivotally mounted on a flange 48 by a pivot 49 so that axial movement of the nut 45 acts to pivot the lever 46, 47 about the pivot 49 thus moving the other end of the lever portion 47 angularly about the pivot 49.

The flange 48 is mounted on the fixed first frame at the corner between the cross member 103 and leg 101. The other end of the lever 47 is attached to the movable inner frame by a further lever 50 pivotally mounted at one end to the lever 47 and the other end to the frame portion 28. A comparison of the positions of the inner frame shown in FIGS. 1 and 4 will show that the axial movement of the nut 45 has caused the inner frame to pivot in an anticlockwise direction about the pivot pins 32. Twisting of the second or inner frame is avoided by communicating movement of the nut 45 to a further lever system 47,50 at the other side of the frame by a torsion bar 51 extending from one side to the other side.

The wheelchair including the occupant can therefore be wheeled up the ramp 23 onto the platform 20 by the occupant himself or by an assistant. The guides 38 act to direct the wheelchair onto the platform and prevent any twisting movement until the back of the wheelchair contacts the rear frame defined by the portions 28 and 29. For the comfort of the occupant a padded section 52 is applied to the rear frame and attached to the rectangle defined by the cross member 29 and the portions 33, 34.

In this position the wheels extend rearwardly through the rear frame defined by the members 28, 29 to a position in contact with the cross member 36 so the chair is held rigidly in position by the padding 52, the platform 20, the cross member 36 and the guides 38. In this position the occupant and chair therefore are securely held.

Figure 4:
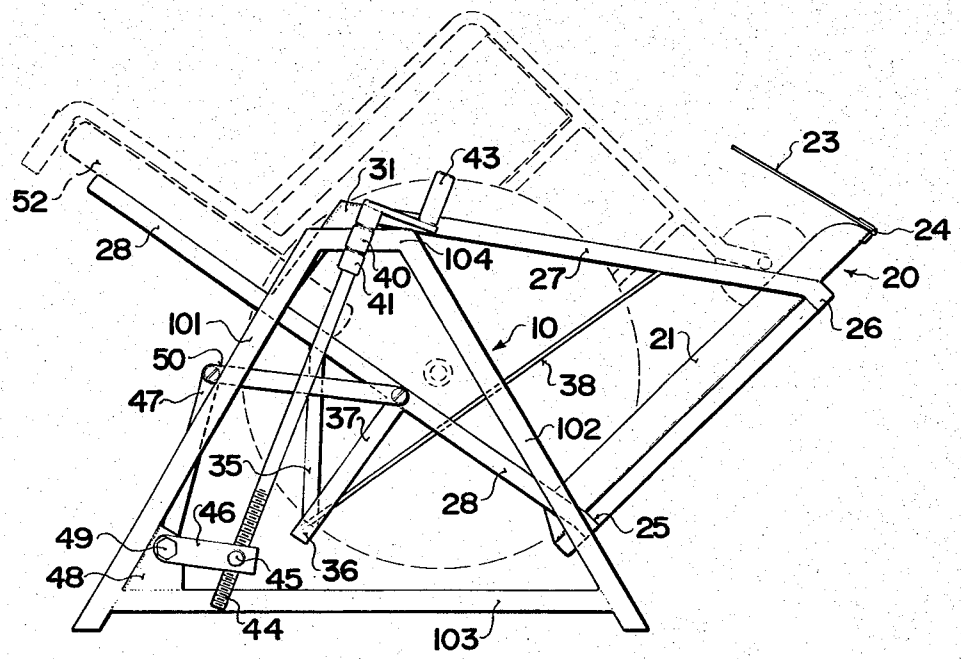
FIG. 4 is a side view similar to that of FIG. 1 showing the apparatus in the tilted position and including a wheelchair accommodated on the apparatus and tilted thereby.

In this position the occupant himself or an assistant can operate the handle 43 to move the nut 45 downwardly on the shaft 39 which acts to move the inner frame in an anticlockwise direction to the position shown in FIG. 4. It will be appreciated that the pivot axis passing through the pins 32 passes through the occupant and lies approximately at the center of gravity of the occupant and chair so the occupant does not experience a disturbing movement of his center of gravity. With the wheelchair and occupant tilted as shown in FIG. 4 the occupant can relax thus varying the loads on his body and reducing discomfort from sitting too long in one position. In addition in the reclined position the occupant can be examined or can have other attention applied. The operation of the tilting device can be carried out either by the occupant himself or by an assistant and hence the occupant can himself move to the tilted position without calling for assistance without any danger of overtilting or the chair leaving its proper securement on the tilting device.

To provide a pleasing appearance and to provide a framework which is rigid and able to support the forces involved, the first and second frames are formed from tubular steel which is chrome plated. The cross section of the tube is square to assist in the assembly generally by welding of the parts.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. Apparatus for tilting a wheelchair and occupant backwardly comprising a first frame having two spaced parallel side frame portions defining a base for mounting on the floor and a transverse pivot axis extending between said side frame portions, a second frame, means mounting the second frame on the first frame inwardly of said side frame portions so as to be pivotally movable thereon about said pivot axis from a first upright position to a second inclined position angularly rotated from the first position and manually operable means for rotating the second frame between the first and second positions, the second frame including a a platform which is substantially horizontal in said first position for receiving the wheels of the wheelchair, a pair of spaced side frame members each arranged inwardly of and adjacent to a respective side frame portion with the platform extending therebetween and an upstanding back support portion rearward of said side frame members for supporting the rear of the chair and the back of the occupant in the second position and a wheel receiving portion extending rearwardly of said back support portion and said platform and inwardly of said side frame members, said mounting means including pivot coupling means for coupling said side frame members to said side frame portions such that the pivot axis is arranged forwardly of the back support portion and passing substantially through the center of gravity of the occupant and chair and the platform is normally raised from the ground whereby a wheelchair can be rolled from the floor onto the platform with the second frame in the first position and the second frame can pivot without vertical movement of the pivot axis.

2. Apparatus according to claim 1 wherein the first frame has two sides each of which is substantially triangular extending upwardly from the base to an apex and wherein the pivot coupling is arranged at the apex such that the pivot axis passes substantially through the apex.

3. Apparatus according to claim 1 wherein the mounting means is arranged such that the pivot axis passes through the occupant.

4. Apparatus according to claim 2 wherein the mounting means is arranged such that the pivot axis passes through the occupant.

5. Apparatus according to claim 1 wherein the second frame includes a ramp whereby the wheels can move from the floor onto the platform with the second frame in the first position.

6. Apparatus according to claim 1 wherein the second frame includes a pair of guide bars extending in parallel relationship and spaced so as to guide the outside edges of the wheels of the wheelchair.

7. Apparatus according to claim 1 wherein the manually operable means comprises a screw, means mounting the screw for rotation about its axis in axially fixed location, a manually operable handle attached to the screw for rotation thereof, a floating nut mounted on the screw for axial movement relative thereto and a lever attached to the nut for communicating axial movement of the nut to the second frame.

8. Apparatus according to claim 7 wherein the lever is pivotally mounted on the first frame.

9. Apparatus according to claim 8 wherein the lever is mounted adjacent one side of the first frame and there is provided a torsion bar for communicating movement thereof to a second similar lever adjacent the opposite side of the first frame.

10. Apparatus according to claim 1 wherein the first and second frames are manufactured from tubular members.

* * * * *